US010160087B2

(12) United States Patent
Kranichsfeld et al.

(10) Patent No.: US 10,160,087 B2
(45) Date of Patent: Dec. 25, 2018

(54) HONING METHOD FOR THE PRECISION MACHINING OF BORES

(71) Applicant: ELGAN-Diamantwerkzeuge GmbH & Co. KG, Nürtingen (DE)

(72) Inventors: Florian Kranichsfeld, Oberboihingen (DE); Joachim Weiblen, Metzingen (DE); Fabio Antonio Xavier, Nürtingen (DE); Oliver Bachmann, Frickenhausen (DE)

(73) Assignee: Elgan-Diamantwerkzeuge GmbH & Co. KG, Nürtingen (DE)

( * ) Notice: Subject to any disclaimer, the term of this patent is extended or adjusted under 35 U.S.C. 154(b) by 44 days.

(21) Appl. No.: 15/313,756

(22) PCT Filed: May 19, 2015

(86) PCT No.: PCT/EP2015/060928
§ 371 (c)(1),
(2) Date: Nov. 23, 2016

(87) PCT Pub. No.: WO2015/180994
PCT Pub. Date: Dec. 3, 2015

(65) Prior Publication Data

US 2017/0190015 A1 Jul. 6, 2017

(30) Foreign Application Priority Data

May 26, 2014 (DE) ..... 10 2014 210 012

(51) Int. Cl.
*B24B 33/02* (2006.01)
*B24B 33/10* (2006.01)

(52) U.S. Cl.
CPC ..... *B24B 33/02* (2013.01); *B24B 33/025* (2013.01); *B24B 33/105* (2013.01)

(58) Field of Classification Search
CPC ..... B24B 33/02; B24B 33/025; B24B 33/105
(Continued)

(56) References Cited

U.S. PATENT DOCUMENTS 3,605,346 A * 9/1971 Sprishevski et al. ... B24B 33/02 451/52
3,853,734 A * 12/1974 Ellis ..... B23H 5/06 204/212

(Continued)

FOREIGN PATENT DOCUMENTS

CN 201505857 U 6/2010
CN 201960443 U 9/2011

(Continued)

OTHER PUBLICATIONS

International Search Report issued in connection with PCT/EP2015/060928.

(Continued)

*Primary Examiner* — George Nguyen
(74) *Attorney, Agent, or Firm* — Akerman LLP

(57) ABSTRACT

A honing method for machining the inner surface of a bore in a workpiece via at least one honing operation using an expandable honing tool with an annular cutting group. The method includes coupling of the honing tool to a working spindle of a machine tool, and;

inserting the honing tool into an inlet of the bore with the cutting material elements retracted, until it is in a final insertion position, in which the cutting group is located in an end region of the bore.

Then the honing tool is turned and the annular cutting group is simultaneously expanded to create a cylindrical widening of the bore, followed by (Continued)

withdrawal of the honing tool from the bore with simultaneous turning of the honing tool in such a way that the bore is successively further widened in the direction of the inlet side.

17 Claims, 4 Drawing Sheets

(58) Field of Classification Search
USPC ..... 451/51
See application file for complete search history.

(56) References Cited

U.S. PATENT DOCUMENTS 4,109,418 A * 8/1978 Ebelt ..... B24B 33/02 451/153
4,679,357 A * 7/1987 Richter ..... B24B 33/06 451/155
4,683,680 A * 8/1987 Bender ..... B24B 33/06 451/156
4,907,372 A * 3/1990 Molitor ..... B24B 33/02 451/130
4,980,996 A * 1/1991 Klink ..... B24B 29/08 29/888.06
5,022,195 A * 6/1991 Cattelain ..... B23Q 3/183 451/381
5,701,861 A * 12/1997 Hegemier ..... B24B 33/02 123/193.2
6,012,973 A * 1/2000 Nagel ..... B24B 1/00 451/27
6,585,571 B2 7/2003 Hyatt et al.
7,416,475 B2 * 8/2008 Blaut ..... B24B 33/02 451/11
2008/0305716 A1 * 12/2008 Tashiro ..... B24B 33/02 451/8
2011/0223833 A1 * 9/2011 Rauscher ..... B23Q 17/2471 451/1
2012/0184182 A1 * 7/2012 Mayer ..... B23Q 15/04 451/5
2012/0231709 A1 * 9/2012 Yamamoto ..... B24B 33/02 451/119
2013/0025124 A1 * 1/2013 Nagel ..... B23B 41/12 29/888.01

FOREIGN PATENT DOCUMENTS

DE 4226335 A1 2/1994
DE 10303215 A1 8/2004
DE 10348419 C5 6/2011
DE 102010010901 A1 9/2011
EP 0693618 A1 1/1996
GB 2419562 A 5/2006
JP H0516030 A 1/1993
JP 2008221445 A 9/2008
JP 2010208004 A 9/2010
JP 2011224719 A 11/2011
JP 2012011522 A 1/2012
WO 2013114527 A1 8/2013

OTHER PUBLICATIONS

Japanese Office Action issued in connection with JP 2016-569873.
German Office Action issued in connection with DE 10 2014 210 012.7.

* cited by examiner

HONING METHOD FOR THE PRECISION MACHINING OF BORES

This application is a national phase of PCT/EP2015/060928, filed May 19, 2015, and claims priority to DE 10 2014 210 012.7, filed May 26, 2014, the entire contents of which are hereby incorporated by reference.

FIELD OF APPLICATION AND PRIOR ART

The invention relates to a honing method for the finishing of an inner surface of a bore in a workpiece according to the preamble of claim 1.

The preferred field of application is the machining of substantially cylindrical sliding bearing surfaces in components for engine construction, in particular the machining of cylinder running surfaces of an engine block or the machining of cylinder-rod eyes in cylinder rods.

Classic honing is a cutting method with geometrically undefined cutting edges, in which the multi-edged honing tool performs a cutting movement which consists of two components and leads to a characteristic surface structure of the machined inner surface. Usually, but not always, a surface structure with crisscrossed machining traces (cross-hatch) is aimed for. The working movement of the honing tool in the workpiece generally consists of an axially back and forth reciprocating movement and a rotary movement superposed thereon. Honing can be used to produce finished surfaces that satisfy extremely high requirements with respect to tolerances of dimensions and shapes and with regard to the surface structure. Accordingly, in engine construction for example, cylinder running surfaces, i.e. inner surfaces of cylinder bores in an engine block or in a cylinder liner to be fitted into an engine block, bearing surfaces for shafts and the cylindrical inner surfaces in connecting-rod eyes, are subjected to a honing machining process.

Tolerances require that bores have a certain position in the workpiece-related system of coordinates. The term "position" refers here to a three-dimensional position of the bores, i.e. both the locational position of a bore and the angular position or the orientation of the bore in the system of coordinates of the workpiece. The position of the bore may be represented for example by the position of the bore axis.

Some of the processes preceding the honing generally produce bores with a position that does not coincide with the target position. The object of subsequent machining operations is then to correct the position of the bore toward the target position.

To prepare the workpieces to be machined for the honing, the honing is often preceded by precision drilling (also known as precision turning or precision spindling), that is to say a chip-removing machining process with a geometrically defined cutting edge. The precision drilling may be designed as position-correcting or position-determining precision drilling operations, which establish the target position of the bore. It is consequently possible in subsequent honing operations with a honing tool that is movably mounted to a limited extent cardanically or in some other way for the bore axis that is established by the precision drilling operations to be followed without any further changing of the position. An essential task of the honing operation is then the creation of the required surface roughness, the cylinder form and the diameter.

There are also proposals to displace and thereby set the position of the bore by honing. The patent DE 103 48 419 C5 discloses a honing method for rough honing the circumferential surface of a bore with a partial cut by a honing tool with honing sticks on a working spindle mounted in a floating manner. The term "rough honing" stands here for a honing machining process involving the removal of a relatively large amount of material. The honing tool is positioned with its longitudinal axis at the target position of the bore and is inserted into the bore centrally in relation to the target position of the bore. Therefore, if there is an offset in relation to the longitudinal axis of the bore before the honing, the longitudinal axis of the working spindle lies eccentrically in relation to the bore. During the honing operation, the removal of the material in the bore is performed in such a way that a displacement of the longitudinal axis of the bore takes place, until any deflection that has occurred is eliminated and the longitudinal axis of the finished bore is coaxial with the longitudinal axis of the working spindle. After that, in the coaxial position of the longitudinal axes, the circumferential surface is uniformly honed by rough honing with a full cut. In order to increase the stiffness of the arrangement, for a certain period of the process with the working spindle the carriage unit is arrested in the longitudinal direction of the working spindle in such a way that the reciprocating movement of the honing tool is performed by the carriage unit, so that the working spindle is moved by the carriage unit alternately with respect to its longitudinal axis.

The positional displacement of the bore axis is brought about here by way of a more or less rigid or stiff design of the honing machine, the spindle and the honing tool. The desired target position is moved to exactly; the stiffness in the honing machine, the working spindle and the honing tool brings about the effect that during the machining operation the position of the bore approaches the position of the tool, and consequently the target position.

DE 10 2010 010 901 A1 describes a honing method for the honing machining of crankshaft bearing bores. In this case, a honing operation involving removal of a large amount of material is carried out as an axial position-correcting honing operation in such a way that a displacement of the bore axis in the direction of the target position is effected by the honing operation. For this purpose, the honing tool is supported at a distance from the coupling point in relation to the working spindle in the radial direction, at least one cutting group of the honing tool being located between the supporting point and the coupling in relation to the drive rod.

The conventional methods mentioned for correcting the position of the bore by means of honing require considerable effort in the structural design of the machine tool and/or the honing tool in order to make them sufficiently stable with respect to the transverse forces occurring during the honing. The workpieces may be exposed to considerable forces during the machining.

Problem and Solution

The invention addresses the problem of providing a honing method for finishing an inner surface of a bore in a workpiece that allows with relatively little design effort in the structural design of the machine tool and/or the honing tool a bore to be machined in such a way that if need be a correction of the position of the bore can be achieved by means of honing. In particular, a position-correcting machining of relatively unstable workpieces is to be made possible without permanent deformation of the workpieces.

To solve this and other problems, the invention provides a honing method with the features of claim 1. Advantageous developments are specified in the dependent claims. The wording of all of the claims is made the content of the description by reference.

The honing method comprises a honing operation in which an expandable honing tool is used, having in an end region of a tool body that is remote from the spindle an expandable, annular cutting group with a number of cutting material elements distributed around the circumference of the tool body, wherein an axial length of the cutting material elements is less than the effective outside diameter of the annular cutting group with the cutting material elements fully retracted. Such a honing tool is also referred to in this application as a "ring tool".

The honing tool is rigidly coupled to a working spindle of a machine tool, it being possible for the coupling to take place directly or by interposing a rigid drive rod. The coupling is in this case performed in such a way that the tool axis (longitudinal center axis, axis of rotation) extends coaxially in relation to the spindle axis of the working spindle. The rigid coupling has the effect that this orientation is also retained when transverse forces act on the honing tool.

The honing tool and the bore are positioned in relation to one another in such a way that the tool axis of the honing tool lies coaxially with the target position of the bore axis of the bore. This may take place by transverse movements of the working spindle in a plane perpendicular to the spindle axis and/or by transverse movements of the workpiece containing the bore in a plane perpendicular to the bore axis.

In an inserting operation, the honing tool is inserted into the bore with the cutting material elements partially or fully retracted, until it is in a final insertion position, in which the cutting group is located in an end region of the length to be machined of the bore that is remote from the inlet. The cutting material elements are in this case retracted to such an extent that they cannot touch the inner wall of the bore at any point during insertion. The relative positioning of the honing tool with respect to the bore can consequently be performed at a time before or after the insertion operation or else partly at the same time.

At the end of the inserting operation, the axially relatively narrow annular cutting group is located in the end region remote from the inlet, which for example in the case of a blind-hole bore may lie directly in the vicinity of the bottom of the bore or only a small axial distance away.

In a subsequent expanding operation, the honing tool is turned about its tool axis and at the same time the annular cutting group is expanded, so that its effective outside diameter gradually increases. The expanding is continued until the cutting material elements reach a first radial position in such a way that a cylindrical widening of the bore that is substantially centered in relation to the target position of the bore axis is created by the material-removing engagement of cutting material elements on the inner side of the bore in said end region of the bore. As a result of the turning of the tool and the simultaneous expansion (increase in diameter) of the cutting group, the cutting material elements dig into the wall of the bore at least over part of the circumference of the bore to be machined, so that the cylindrical widening is produced. Since, during the expanding operation, the honing tool rotates coaxially in relation to the tool axis, which in turn lies at the location of the target position of the bore axis, the cylindrical widening of the bore is created in such a way that its center coincides with the target position of the bore axis.

After completion of the expanding operation, during which the cylindrical widening is produced, a withdrawal of the honing tool from the bore is performed in a drawing operation with simultaneous turning of the honing tool in such a way that, from the widening, the bore is successively widened in the direction of the inlet side of the bore. This achieves the effect that, after complete withdrawal of the honing tool from the bore, the bore is centered in relation to the bore axis, that is to say the desired target position is obtained.

With this procedure it is consequently possible to start with a form of bore before the beginning of the honing operation that is possibly not centered, not correctly oriented and/or not circular-cylindrically shaped and produce a circular-cylindrical bore of which the bore axis lies exactly at the target position of the bore axis and has the desired angular position. Consequently, the honing operation allows the position of the bore to be changed and corrected in the direction of the target position.

Depending on the degree of the deviation of the position of the bore before the beginning of the honing operation, relatively strong transverse forces (forces with components perpendicular to the tool axis) may in this case occur between the honing tool and the workpiece or the wall of the bore and it may be necessary that material is removed unevenly over the circumference of the honing tool. These transverse forces are counteracted during the withdrawal of the honing tool from the bore by relatively strong straightening forces, which on account of the tensile loading act in the direction of the target position of the honing tool, so that the honing tool has a tendency to center itself during the drawing operation. As a result, the precision in the centering of the bore can be improved. Furthermore, a less stiff design of the machine is required than in those cases in which honing tools are inserted into the not optimally positioned bore in the case of bore-correcting honing operations with material removal from the inlet side. Moreover, the process of producing the centered bore begins in the region of the cylindrical widening, that is to say at the end of the region of the bore to be machined that is remote from the inlet. In this region, bores are often joined to the remaining material of the workpiece, so that the bore or the material of the workpiece in this region cannot move away during the creation of the cylindrical widening even with unstable workpiece structures and permanent deformations of the workpiece can be avoided.

The axially narrow configuration of the cutting group, that is to say its short axial extent in relation to the outside diameter, also contributes to only relatively small lateral deflecting forces occurring, and also only over a relatively short distance or only over a small axial length. The configuration with an annular cutting group also has the effect that great cutting performances can be achieved with relatively low pressing forces and that the distances for carrying away the material removed, that is to say abraded matter, are relatively short. As a result, clogging of the abrasive cutting surfaces of the cutting elements with abrasive matter can be avoided and the cutting elements permanently retain their cutting properties. The short type of construction also means that better supplying of cooling lubricant is possible than with longer honing sticks, thereby in turn making it possible to operate the honing tool for material removal at relatively high rotational speeds, so that greater removal can be achieved with lower cutting forces.

In comparison with conventional honing sticks, one distinguishing aspect of an annular cutting group is that there is significantly more contact area between cutting material elements and the inner surface of the bore in the axial portion that is covered by the annular cutting group than in a comparably narrow axial portion of a conventional honing tool with relatively narrow honing sticks. In the case of some embodiments, on the annular cutting group more than 60% of the circumference is covered with cutting means, in particular even more than 70% or more than 80% of the circumference of the cutting group.

The axial length of the cutting material elements may for example be less than 30% of the effective outside diameter of the honing tool, in particular between 10% and 20% of this outside diameter. In the case of honing tools for the machining of typical cylinder bores in engine blocks for passenger cars or trucks, the axial length may for example lie in the range of 5 mm to 20 mm. With respect to the bore length of a bore to be machined, the axial length may for example be less than 10% of this bore length.

Honing tools in which the cutting material elements are configured as honing segments that are wide in the circumferential direction and narrow in the axial direction are preferably used, an axial length of the honing segments, measured in the axial direction, being less than the width measured in the circumferential direction. A honing segment is generally intrinsically rigid, so that the complete honing segment is moved as a whole during the adjustment. The honing segment may define an uninterrupted cutting surface; the cutting surface may however possibly also be interrupted one or more times.

If at least three honing segments are provided, the machining forces can be distributed well and relatively uniformly over the circumference of the cutting group over the entire effective outside diameter of the honing tool that is available as a result of expansion. For example, precisely three, precisely four, precisely five or precisely six honing segments of the same circumferential width or different circumferential widths may be provided in the cutting group. Although it is possible to have more than six honing segments within a cutting group, this makes the structural design more complicated and is generally not necessary. In some cases, it may possibly even be sufficient if the honing tool has only two honing segments.

The honing tool is preferably structurally designed in such a way that the cutting material elements can be radially adjusted, so that for example the cutting material elements can be adjusted radially (perpendicularly to the tool axis) during the expansion of the cutting group. The radial adjustability, i.e. a displacement of the honing segments in the radial direction during the adjustment, allows the effect to be achieved that the engagement conditions between the cutting material elements and the inner surface of the bore can remain virtually constant irrespective of the diameter that is set. Avoiding tilting of the cutting material elements during the radial adjustment means that uneven wear can be avoided.

In the case of some embodiments, the cutting material elements form a wedge-shaped cutting surface, a circumferential width of the cutting surface on a side near the spindle being wider than on a side remote from the spindle (an example of which is seen in FIG. 4). The cutting material elements are therefore made wider on the side that engages first in the material to be removed during the withdrawal of the honing tool, whereby necessary uneven wear can to a certain extent be counteracted.

For a position-correcting effect of the honing method, it is generally advisable if the widening is created in such a way that a difference in diameter between the cylindrical widening and an adjoining, not (yet) widened portion of the bore after the creation of the cylindrical widening and before the beginning of the drawing operation is at least 100 μm. The difference in diameter is preferably at least 200 μm, it being possible for example for it to lie between 200 μm and 500 μm. Therefore, in a drawing operation, a considerable amount in the range of one or more tenths of a millimeter (with respect to the diameter) can be removed in an upward stroke, i.e. a stroke in the direction of the inlet opening. Possibly also great positional errors of the bore can be corrected.

In order that the honing tool can center itself in relation to the target position of the bore before the beginning of the drawing operation largely without any external transverse forces, in the case of some embodiments it is provided that, after the creation of the cylindrical widening, a relieving operation is carried out to relieve the honing tool before the beginning of the withdrawal. In the relieving operation, the cutting material elements are preferably returned from the first radial position to a second radial position by a predeterminable return amount, it being possible for the return amount to be for example between 10 μm and 15 μm. In this case, the radially outer lying cutting surfaces of the cutting material elements may possibly come away from directly engaging with the inner side of the cylindrical widening, so that as a result of possible residual elasticities on the drive side (working spindle, possibly drive rod) the honing tool can move itself into the central position, from where the subsequent drawing operation then begins. Alternatively or in addition, relief could also be achievable by the honing tool being axially inserted a few more micrometers.

In the case of some variants of the method, during the expanding operation the honing tool is merely expanded and the cutting group remains at the final insertion position, without being moved axially. In the case of other variants of the method, during the expanding of the cutting group to create the widening a short-stroke axial oscillating movement is superposed on the rotation of the honing tool, at least in certain phases. This allows the removal of material to be increased further. Short lengths of stroke, for example in the range of 2 mm to 3 mm, are generally sufficient for this.

In the expanding operation that leads to the creation of the cylindrical widening, working is generally carried out at relatively high tool speeds of several hundred rpm, in particular at speeds of 500 rpm or more, for example in the range between 500 and 2000 rpm. High speeds are generally beneficial to achieve high rates of material removal per unit of time in spite of relatively low cutting forces.

In order when withdrawing the honing tool to achieve sufficient removal of material without overly prolonging the cycle times of the process, it has been found to be advantageous to work during the withdrawal of the honing tool with a stroke rate in the range of 0.1 m/s to 2 m/s, in particular in the range of 0.3 m/s to 0.7 m/s. Optimal values within these ranges, depending on the material, on the cutting means and possibly other parameters, can be determined by a few trials. With some materials, it may also be that smaller stroke rates are necessary or greater stroke rates are possible.

In the case of most variants of the method, honing tools in which the cutting material elements have abrasive grains with an average grain size in the range of 50 μm to 250 μm are used. With grain sizes in this range, sufficiently efficient material removal is generally possible, while at the same time the surface structures resulting after the withdrawal of the honing tool are optimized in such a way that subsequent machining stages, in particular by honing, only have to provide a small removal of material.

In the case of some variants of the method, an expandable honing tool with relatively large honing sticks, the length of which is much greater than their width in the circumferential direction, are used in a further honing operation following the position-correcting honing operation. It may be a conventional long-stroke honing tool. The length of the honing sticks may be for example more than 30% or more than 40% of the length of the bore. As a result, after the position correction the cylinder shape of the bore can still be improved if need be by means of honing.

The machine tool may be a honing machine designed specifically for honing methods, but possibly also some other suitably equipped machine tool, for example a machining center or a grinding machine. The workpiece to be machined is taken up and held by a workpiece holding device of the machine tool.

In order to start the honing tool in its working movement for a honing operation, the working spindle is turned about the associated spindle axis by means of a rotary drive. The axial reciprocating movement in relation to the machined workpiece that is superposed on the rotation can be produced in various ways. In many cases, the workpiece does not move in the axial direction during the machining, while the rotating movement and the reciprocating movement are produced by corresponding rotation and reciprocating movement of the working spindle of the machine tool and are transmitted to the honing tool (workpiece axially at rest). It is also possible to bring about the reciprocating movement by translational movement of the workpiece with the working spindle axially at rest or by a coordinated combination of axial movements of the workpiece and the working spindle. For this, the machine tool has a reciprocating drive for producing an axial reciprocating movement of the working spindle and/or the workpiece holding device parallel to the spindle axis.

The honing tool described in this application and the variants thereof that are described may be patentable by themselves, i.e. independently of the method.

BRIEF DESCRIPTION OF THE DRAWINGS

Further advantages and aspects of the invention are provided by the claims and the following description of preferred exemplary embodiments of the invention, which are explained below on the basis of the figures, in which:

DETAILED DESCRIPTION OF THE EXEMPLARY EMBODIMENT

Figure 1:
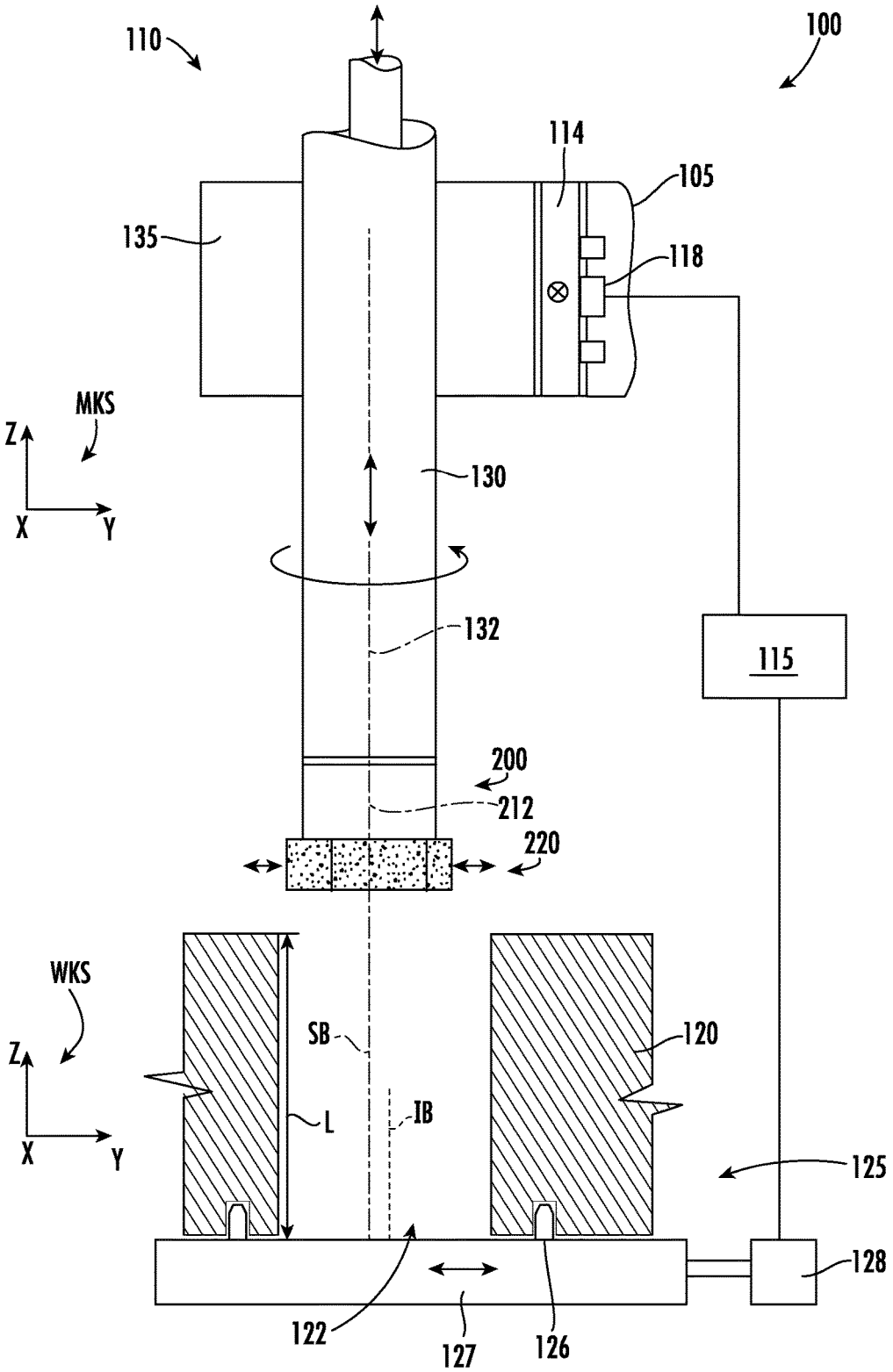
FIG. 1 shows a schematic view of part of a multi-axis machine tool in the form of a honing machine when carrying out an embodiment of the honing method.

In FIG. 1, a schematic view of part of a numerically controlled, multi-axis machine tool 100 in the form of a honing machine 100 is shown in a direction parallel to the x direction of the system of machine coordinates MKS. The honing machine has a number of honing units, which are arranged next to one another in the x direction and can be operated simultaneously. In FIG. 1, some of the components of a honing unit 110 are represented. A control device 115 controls working movements of movable components of the honing machine.

The honing machine is designed for honing cylinder running surfaces in the production of cylinder blocks for internal combustion engines. A workpiece 120 that is currently to be machined is securely clamped on a workpiece holding device 125. The position of the workpiece on the workpiece holding device is predetermined by means of indexing elements 126, so that there is a defined reference between the system of workpiece coordinates WKS and the system of machine coordinates MKS. The workpiece holding device has a horizontally movable carriage 127, which can be moved parallel to the y direction of the system of machine coordinates MKS by means of a drive 128 that can be activated by way of the control device 115.

In the case of the example, the workpiece is a cylinder crankcase of a 4-cylinder in-line engine with four axially parallel cylinder bores. The bore 122 to be machined next can be seen; the other bores lie offset in the x direction.

The honing unit 110 is attached to the front side of a vertical carrier structure 105 mounted on the machine bed of the honing machine. The honing unit comprises a headstock 135, which serves as a mounting for the working spindle 130, which is guided in the headstock with a vertical spindle axis 132. The rotation of the working spindle about the spindle axis is brought about by a rotary drive (not represented), which is attached to the headstock and acts on the working spindle for example by way of a chain drive. A reciprocating drive, which is structurally connected to the headstock, brings about the vertical movements of the working spindle that run parallel to the spindle axis 132 during the insertion of the later-to-be-explained honing tool 200 into the bore to be machined or during the withdrawal of the honing tool from this bore. Furthermore, during the honing machining process the reciprocating drive can be activated by the control device 115 in such a way that the honing tool performs within the bore of the workpiece a vertical back-and-forth movement corresponding to the desired honing parameters.

In the case of the example, the honing tool 200 is rigidly coupled to the free end of the working spindle 130. For establishing the rigid, but releasable connection between the working spindle and the honing tool, a correspondingly secured bayonet connection, a screw connection, a flange connection or a cone connection, for example with a hollow shank taper (HSK), may be provided for example. Neither in the working spindle nor in the honing tool is a joint provided. In the unloaded state, i.e. in the absence of transverse forces acting on the honing tool, the central tool axis 212 of the honing tool runs coaxially with the spindle axis 132 in the region of its mounting in the headstock.

The honing unit 110 with the vertical working spindle 130 contained therein is linearly movable as a whole in the horizontal direction parallel to the x axis of the system of machine coordinates MKS, that is to say perpendicularly to the spindle axis in a transverse direction. This makes it possible inter alia, without displacing the workpiece, to first machine a first bore on a workpiece, then withdraw the working spindle, move the honing unit as a whole in a transverse movement parallel to the x direction and position it approximately coaxially in relation to a second bore to be machined thereafter, in order to machine the second bore with the same honing unit. Horizontal transverse movements in the x direction may also be used to move the honing unit to a tool changer arranged in line with the transverse movement. In order to make the horizontal transverse movement possible, the headstock is mounted on a horizontally movable carriage 114, which is linearly guided on two horizontal guide rails on the front side of the carrier structure 105 that is facing the headstock. The transverse movement is brought about by a positioning drive 118, which is arranged between the carrier structure and the carriage 114.

In the honing operation described in more detail below, a honing tool 200 of a particular structural design, which in the application is also referred to as a "ring tool", is used (cf. also FIG. 2). The honing tool has a cutting group 220, which is attached annularly to the tool body 210 and has cutting material elements 220-1 to 220-3, which are distributed around the circumference of the tool body and can be adjusted and retracted in the radial direction by means of an assigned adjusting system. The cutting material elements are configured as honing segments, the width of which in the circumferential direction is clearly greater than the length in the axial direction. The abrasive cutting material elements that are responsible for the removal of material from the workpiece are concentrated in an axially relatively narrow zone (annular cutting group) and take up a relatively large proportion of the circumference of the honing tool.

Figure 2A:
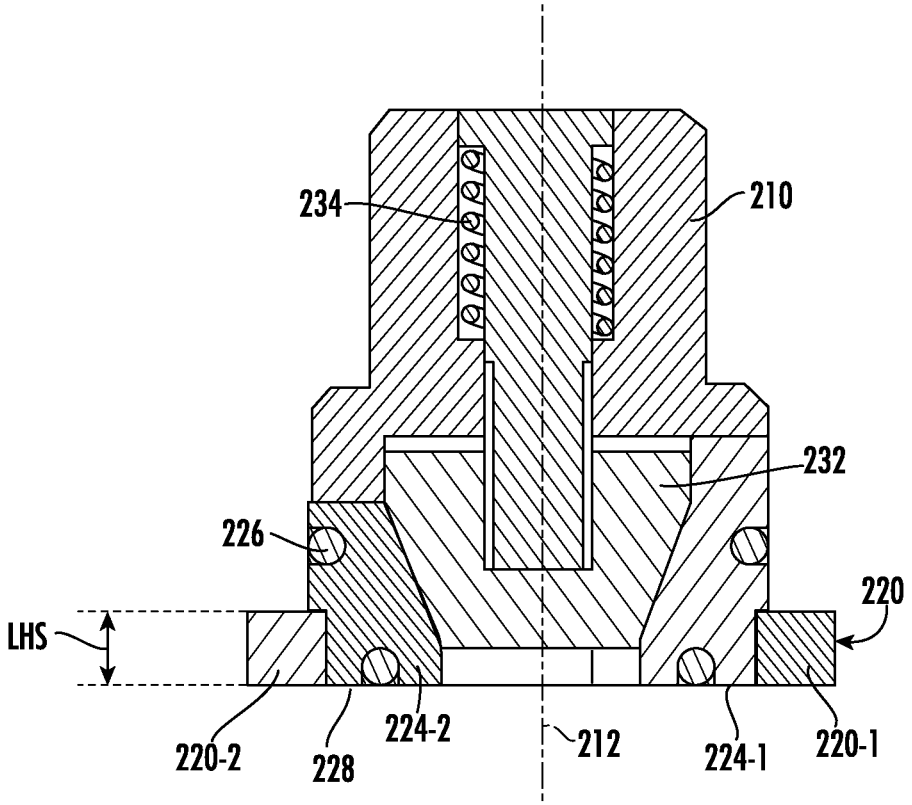
FIG. 2 shows in FIG. 2A an axial section and in FIG. 2B a cross section through an embodiment of a honing tool with an annular cutting group.
Figure 2B:
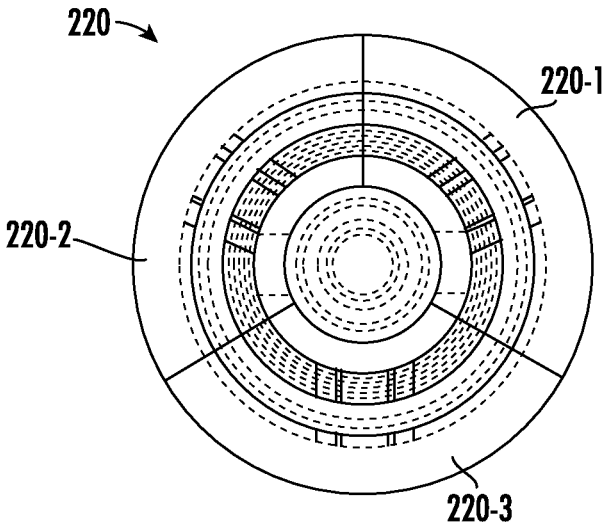

FIG. 2 shows, in 2A, a longitudinal section through an embodiment of a ring tool 200 with a single annular cutting group 220 and single widening. FIG. 2B shows a cross section through the cutting group. The ring tool 200 has a tool body 210, which defines a tool axis 212, which at the same time is the axis of rotation of the ring tool during the honing machining process. At the spindle-side end of the ring tool (at the top in FIG. 2A) there is a coupling structure (not represented any more specifically) for the rigid coupling of the ring tool to a drive rod or a working spindle of a honing machine or of some other machine tool that has a working spindle, which is both rotatable about the spindle axis and movable back and forth in an oscillating manner parallel to the spindle axis.

At the spindle-remote end of the tool body (at the bottom in FIG. 2A) there is the annular cutting group 220, which has a number (in the example three) of cutting material bodies 220-1, 220-2, 220-3, which are distributed uniformly over the circumference of the tool body and can be adjusted radially outwardly in relation to the tool axis 212 with the aid of a cutting-material-element adjusting system in order to press the abrasively acting outer sides of the cutting material element, i.e. the cutting surfaces, with a defined pressing force against the inner surface of a bore to be machined. Each of the three arcuately curved cutting material elements is configured as a honing segment which in the circumferential direction is very wide, by contrast in the axial direction is narrow and covers a circumferential angular region of between 115° and 120°. The honing segments are decoupled from the tool body and are displaceable relative to the latter radially in relation to the tool axis 212. The ring formed by the honing segments ends on the spindle-remote side flush with the tool body, so that the ring fits completely within the spindle-remote half of the tool body at the spindle-remote end of the ring tool.

Finishing flush with the lower end of the tool body is favorable, but not absolutely necessary. Generally, the ring should fit in the spindle-remote third or in the spindle-remote quarter of the tool body; there may be a small distance from the end face of the tool body.

The axial length LHS of the honing segments is less than 15%, in particular less than 10%, of the bore length L. The honing segments are about 4 mm to 35 mm, in particular about 10 mm, high (in the axial direction), which in the case of the example corresponds to between 5% and 30%, in particular between 10% and 20%, of the effective outside diameter of the cutting group with the cutting material elements inwardly retracted to the maximum. The honing tool has only this one annular cutting group. The axial length LHS therefore at the same time corresponds to the axial length of the entire cutting region of the honing tool.

Each cutting material element is fastened to the outer side of an assigned steel carrying strip 224-1, 224-2 by brazing. Alternatively, the cutting material element may also be fastened by adhesive bonding or by means of screwing, making it more easily possible for it to be exchanged. Each carrying strip has on its inner side an oblique surface, which interacts with a conical outer surface of an axially displaceable adjusting cone 232 in such a way that the carrying strips with the cutting material elements carried by them are adjusted radially outwardly when the adjusting cone is pressed in the direction of the spindle-remote end of the ring tool counter to the force of the restoring springs 234, 226, 228 by means of a machine-side adjusting device. In an opposite adjusting movement, the carrying strips with the honing segments are restored radially inwardly with the aid of peripheral restoring springs 226, 228. The radial position of the cutting material elements is thereby controlled in a manner free from play on the basis of the axial position of the adjusting cone 232.

A honing segment may, as shown, have on its outer side a continuous, uninterrupted cutting surface. For this purpose, the cutting coating may consist of a single piece of the cutting means. It is also possible that a number (for example two, three, four, five, six or more) of in each case relatively narrow cutting material elements are provided close together, with or without a spacing between them, on the arcuately curved outer side of a common carrier element. The cutting surface would then be interrupted, which may possibly be favorable for supplying cooling lubricant.

The use of relatively wide honing segments in the annular cutting group may be favorable inter alia when machining bores which, for example for the purpose of gas exchange, have transverse bores that open out on the inner surface to be machined of the bore. Wide, intrinsically rigid honing segments may bridge the region where they open out, so that the honing tool cannot "get stuck". If only a few (for example three) wide honing segments are provided, there must also only be a few radial clearances provided on the tool body, so that improved mechanical stability is obtained, which is favorable specifically in the case of position-correcting machining in order to withstand transverse forces.

This machine and tool concept makes position-correcting, material-removing machining of the inner surface of the bore 122 possible, in order by means of honing to bring the position of the bore to its target position within the tolerances.

An embodiment of a suitable method is explained in more detail on the basis of FIG. 3. FIG. 3 shows for this purpose various phases or various partial operations of a position-correcting honing operation. As schematically shown in FIG. 1, after the previous machining steps the bore 122 is still not at its desired target position, which in the case of the example is represented by the target position SB of the bore axis. Rather, the bore 122 still has a lateral offset in relation to the target position, the actual position of the bore (characterized by the current bore axis IB) lying outside the tolerances alongside the target position. Furthermore, the inner surface of the bore does not yet have the surface structure that it should have for the intended use, which is likewise still to be produced by honing.

Figure 3A:
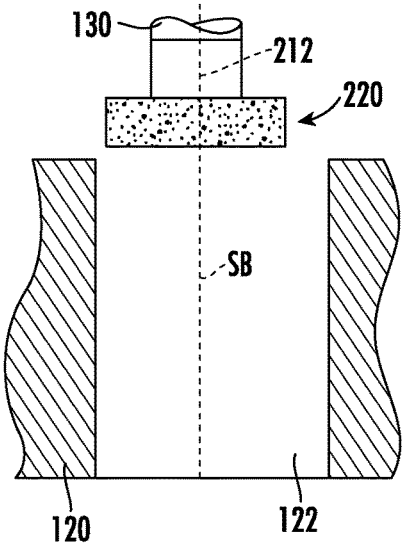
FIG. 3 shows in FIGS. 3A-3F various phases of a position-correcting honing operation.

First, in a positioning operation, the honing tool is positioned in relation to the bore in such a way that the tool axis 212 lies coaxially in relation to the target position SB of the bore. For this purpose, if need be the tool carrier 127 is moved horizontally, parallel to the y direction of the system of machine coordinates, and/or the headstock or the working spindle is moved horizontally, parallel to the x direction of the system of machine coordinates. The coaxial position set by the positioning operation is schematically represented in FIG. 1 and FIG. 3A.

Before, after or at the same time as the positioning, the adjusting rod of the cutting-material-element adjusting system is moved upwardly, until the cutting material elements assume their position of being inwardly retracted to the maximum, whereby the outside diameter of the annular cutting group assumes its smallest value. When moved vertically, the honing tool then fits into the bore without touching the walls of the bore.

Figure 3B:
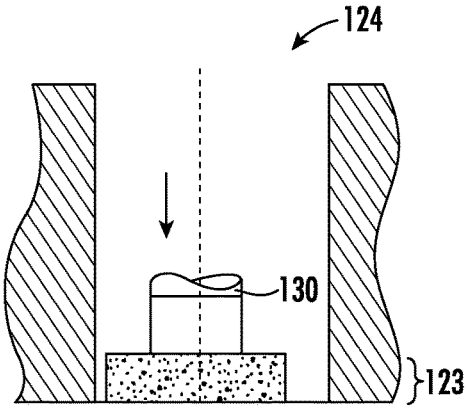

After that, by actuating the reciprocating drive of the working spindle, the honing tool is inserted into the bore 122 and lowered to such an extent that the honing tool reaches a final insertion position, in which the annular cutting group 220 is located in an end region 123 of the bore 122 that is remote from the inlet (FIG. 3B). The end region remote from the inlet of the bore 124 defines the lower end or the remote end of the overall length to be machined of the inner side of the bore. Since, in the case of the annular tool shown, the cutting group 220 is flush with the spindle-remote end face of the tool body, the ring tool can be moved virtually right up against the bottom of the bore or, in the case of through-bores, right up against the upper side of the workpiece mount. In practice, however, a small distance of a few millimeters, for example 1 to 2 mm, is generally maintained. The working spindle may be slowly turned during the inserting operation, but this is not absolutely necessary.

When the honing tool is in the final insertion position, the subsequent partial operation, specifically an expanding operation, can begin. In the expanding operation (FIG. 3C), the honing tool is turned about its tool axis and at the same time the cutting group is slowly expanded by activating the cutting-material-element adjusting system, so that the effective outside diameter of the cutting group gradually increases. If the bore in the end region remote from the inlet is not already centered in relation to the target position of the bore axis and has a circular cross section, in a specific phase of the expanding operation an engagement of the material on one side will first take place, that is to say an abrasive machining with a partial cut in the region of the inner surface of the bore that lies radially closest to the target position of the bore axis. With an increasing effective outside diameter of the cutting group, the partial cut then gradually goes over into a full cut, in the case of which material is removed over the entire circumference of the cutting group.

Figure 3C:
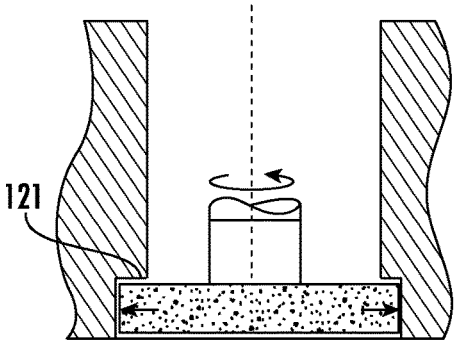
Figure 3D:
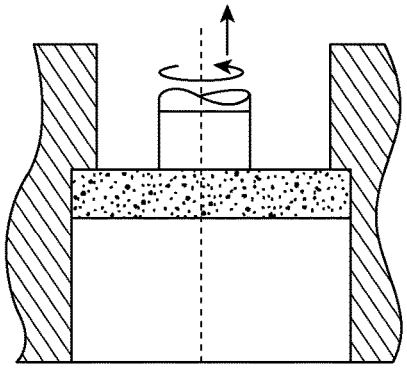
Figure 3E:
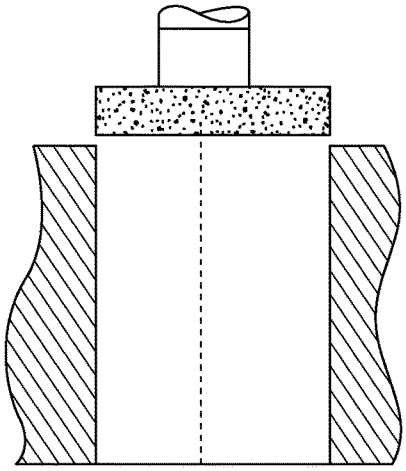

The outward radial adjustment of the cutting material elements is continued until the cutting material elements reach a previously defined first radial position (FIG. 3C). After that, further adjustment is stopped by the control device. The removal of material over the circumference of the cutting group together with the radial adjustment has the effect that in the expanding operation a cylindrical widening 121, which is generally centered exactly within the tolerances in relation to the target position of the bore axis, is created in the end region 123 of the bore by material-removing engagement of cutting material elements on the inner side of the bore. In the case of a not exactly positioned bore, the cylindrical widening will still lie decentered in relation to the current bore axis. The oversize of the widening with respect to the portion of the bore adjoining the bore inlet is generally at least 100 μm with reference to the diameter. Usually, the values are higher, for example at 200 μm or more or at 400 μm or more.

It has been found in trials that rotational speeds of the honing tool in the range of 400 rpm to 1000 rpm generally produce good results in the expanding operation. In one case, work was performed at about 500 rpm using oil as a cooling lubricant.

In the case of one variant of the method, the honing tool remains at the set axial position during the expanding operation, so that no reciprocating movement is superposed. In the case of other variants of the method, during the expanding operation the reciprocating drive of the working spindle is actuated at least in certain phases in order to superpose an axially short-stroke oscillating movement on the rotating movement of the honing tool during the radial expansion. As a result, possibly more favorable material removal conditions can be achieved. The axial length of the cylindrical widening created would then turn out to be slightly larger than in the case of merely radial expansion without a superposed reciprocating movement.

Figure 5:
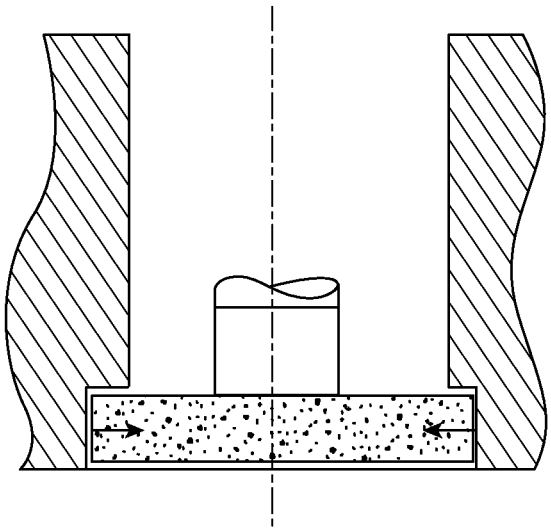
FIG. 5 shows an embodiment of a honing tool being relieved in a relieving operation.

In the case of one variant of the method, after completion of the expanding operation, i.e. when the cutting material elements have reached the first radial position, the honing tool is relieved in a relieving operation by the cutting material elements being returned to a second radial position by a certain returning amount, for example 10 to 15 μm. An example of this is shown in FIG. 5, with the arrows directed inwardly towards the rotation axis of the honing tool As a result, the touching contact between the outer surface of the honing segments and the inner wall of the bore is ended, so that the honing tool can possibly center itself even better with reference to the spindle axis under the effect of elastic forces from the working spindle. This step may also be omitted.

After completion of the expanding operation, and possibly after the relieving operation, a drawing operation (FIG. 3D) is initiated, in which the honing tool driven in a rotating manner is slowly withdrawn at a suitable stroke rate from the bore in the direction of the bore inlet. This has the effect of producing from the bottom of the bore a gradual extension of the cylindrical widening, centered in relation to the target position of the bore axis, so that, as it were starting from the base of the bore, the bore is given its circular-cylindrical bore shape, centered in relation to the target position of the bore axis. After complete withdrawal of the honing tool from the bore (FIG. 3E), the bore is centered over the full length with respect to the target position of the bore axis. The angularity of the bore is also correctly set, so that the bore axis is for example oriented perpendicularly in relation to the top surface.

For the partial operation of withdrawing the honing tool (with at the same time axially increasing the cylindrical widening), the stroke rates typically lie in the range between 0.3 m/s and 0.7 m/s, but they may also be less, for example down to below 0.1 m/s, or else greater, up to more than 1 m/s, for example up to about 2 m/s.

In some cases, it may be adequate to carry out these honing operations (including insertion of the honing tool, expansion to create a cylindrical widening, withdrawal) only a single time. However, it is also possible to repeat these working steps one or more times, which may be favorable in particular whenever the positional error of the bore before the first machining process is relatively high and/or if it is desired to produce in each case during the drawing operation only a smaller removal of material than is ultimately required.

Figure 3F:
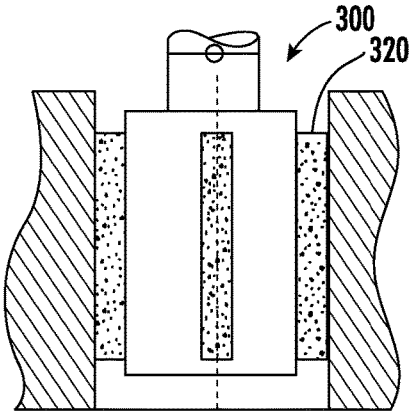
Figure 4:
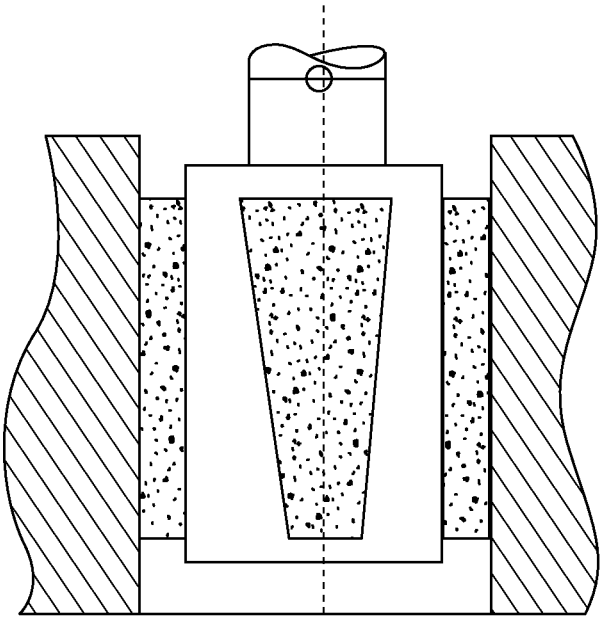
FIG. 4 shows an embodiment of a wedge-shaped cutting surface on a honing tool.

After the position-correcting honing operation, further machining operations may follow. In the case of some variants of the method, subsequently at least one further honing operation is carried out with the aid of a conventional expandable honing tool 300, which is coupled in a singly or multiply articulated manner to the working spindle and has relatively long honing sticks 320, the length of which may for example be more than 30% of the length of the bore (FIG. 3F). This allows possibly still existing errors in the cylinder shape and/or other shape errors still to be corrected.

As shown, the method can be carried out with a vertical axial direction. Horizontal machining is also possible. As shown, the bore may be uncoated, so that the base material of the workpiece is removed directly. Machining of coated bores is likewise possible, the material of the coating then being removed.

A ring tool may possibly have in addition to the spindle-remote ring a separately adjustable further ring with cutting material elements.

For a similar material-removing, position-correcting finishing method, it may also be possible to use instead of a ring tool that is configured for honing a finishing tool that has at least one activatable cutting element with a geometrically defined cutting edge (instead of an annular cutting group with geometrically undefined cutting edges) attached at the end to the spindle-remote end. There may possibly be at least one pair of activatable cutting elements lying diametrically opposite one another. The method steps: insertion of the finishing tool, expansion and withdrawal of the cutting element with at the same time rotation to create a cylindrical widening, withdrawal with extended cutting element and simultaneous rotation, could be carried out in a way analogous to the procedure described.

The invention claimed is:

1. A honing method for machining the inner surface of a bore in a workpiece by means of at least one honing operation, in particular for honing cylinder running surfaces in the production of cylinder blocks or cylinder liners for reciprocating piston engines, wherein in a honing operation an expandable honing tool is used, having in an end region of a tool body that is remote from the spindle an expandable, annular cutting group with a number of cutting material elements which are distributed around the circumference of the tool body and the axial length of which is less than the effective outside diameter of the cutting group with the cutting material elements fully retracted, the method comprising the following steps:

rigid coupling of the honing tool to a working spindle of a machine tool;

relative positioning of the honing tool and the bore in such a way that a tool axis of the honing tool is coaxial with a target position of a bore axis of the bore;

inserting the honing tool into the bore with the cutting material elements retracted, until the honing tool is in a final insertion position, in which the cutting group is located in an end region of the length to be machined of the bore that is remote from an inlet;

turning of the honing tool and simultaneous expansion of the cutting group at or in the region of the final insertion position into a first radial position of the cutting material elements in such a way that a cylindrical widening of the bore that is substantially centered in relation to the target position of the bore axis is created by the material-removing engagement of cutting material elements on the inner side of the bore in the end region of the bore;

withdrawing the honing tool from the bore with simultaneous turning of the honing tool in such a way that, from the cylindrical widening, the bore is successively widened in the direction of an inlet side.

2. The honing method as claimed in claim 1, wherein a honing tool that has at least one of the following properties is used:

(i) on the annular cutting group more than 60% of the circumference is covered with cutting means;

(ii) the axial length of the cutting material elements is for example less than 30% of the effective outside diameter of the cutting group;

(iii) the axial length of the cutting material elements lies in the range of 5 mm to 20 mm;

(iv) the axial length of the cutting material elements is less than 10% of the bore length of the bore.

3. The honing method as claimed in claim 1, wherein the cutting material elements are configured as honing segments that are wide in the circumferential direction and narrow in the axial direction, an axial length of the honing segments, measured in the axial direction, being less than the width measured in the circumferential direction.

4. The honing method as claimed in claim 1, wherein the cutting group has at least three honing segments of the same circumferential width or different circumferential widths.

5. The honing method as claimed in claim 1, wherein a honing tool in which the cutting material elements form a wedge-shaped cutting surface is used, a circumferential width of the cutting surface on a side near the spindle being wider than on a side remote from the spindle.

6. The honing method as claimed in claim 1, wherein a honing tool in which the cutting material elements have abrasive grains with an average grain size in the range of 50 μm to 250 μm is used.

7. The honing method as claimed in claim 1, wherein the cutting material elements are adjusted radially during the expansion of the cutting group.

8. The honing method as claimed in claim 1, wherein the widening is created in such a way that a difference in diameter between the widening and an adjoining, non-widened portion of the bore is at least 100 μm.

9. The honing method as claimed in claim 1, wherein, after the creation of the cylindrical widening, a relieving operation is carried out to relieve the honing tool before the beginning of the withdrawal.

10. The honing method as claimed in claim 9, wherein, in the relieving operation, the cutting material elements are returned from the first radial position to a second radial position by a return amount, the return amount preferably being between 10 μm and 15 μm.

11. The honing method as claimed in claim 1, wherein the withdrawal of the honing tool takes place with a stroke rate in the range of 0.1 m/s to 2 m/s.

12. The honing method as claimed in claim 1, wherein during the expanding of the cutting group to create the widening a short-stroke axial oscillating movement is superposed on the rotation of the honing tool, at least in certain phases, an axial stroke lying in the range of 2 mm to 3 mm.

13. The honing method as claimed in claim 1, wherein an expandable honing tool with honing sticks of which the length is greater than their width in the circumferential direction is used in a further honing operation following the position-correcting honing operation, the axial length being more than 30% of the length of the bore.

14. The honing method as claimed in claim 2, wherein more than 80% of the circumference of the cutting group is covered with cutting means, and the axial length of the cutting material elements is between 10% and 20% of the effective outside diameter of the cutting group.

15. The honing method as claimed in claim 4, wherein the cutting group has between three and six honing segments.

16. The honing method as claimed in claim 8, wherein the difference in diameter between the widening and an adjoining, non-widening portion of the bore is at least 200 μm.

17. The honing method as claimed in claim 11, wherein the withdrawal of the honing tool takes place with a stroke rate in the range of 0.3 m/s to 0.7 m/s.

* * * * *